United States Patent [19]

Swanson, Jr.

[11] Patent Number: 4,699,406

[45] Date of Patent: Oct. 13, 1987

[54] AUTOMATIC BOLT LOCK

[76] Inventor: Chester Swanson, Jr., 43 Jackson Rd., Medford, Mass. 02155

[21] Appl. No.: 824,563

[22] Filed: Jan. 23, 1986

[51] Int. Cl.[4] ..... E05C 5/02

[52] U.S. Cl. ..... 292/175; 292/DIG. 47

[58] Field of Search ..... 292/175, 60, 152, 57, 292/62, 58, 59, 61, 69, DIG. 47

[56] References Cited

U.S. PATENT DOCUMENTS

| | | | |
|---|---|---|---|
| 1,389,709 | 9/1921 | Subber | 292/60 |
| 1,647,128 | 11/1927 | Frisbie | 292/60 |
| 1,815,422 | 7/1931 | Songey | 292/60 |
| 3,436,860 | 4/1969 | James | 292/103 X |
| 3,854,312 | 12/1974 | Van Gompel | 292/60 X |

FOREIGN PATENT DOCUMENTS

| | | | |
|---|---|---|---|
| 618300 | 2/1949 | United Kingdom | 292/152 |

*Primary Examiner*—Richard E. Moore

*Attorney, Agent, or Firm*—Donald W. Meeker

[57] ABSTRACT

A bolt fits slidably within a cylinder and is inserted in a drilled hole through a first slidable member to be interlocked. The bolt, under force of a coil spring within the cylinder, is forced into any of a series of aligned holes in a second member to be interlocked. A striker plate with aligned holes is attached to the second member and receives the end of the bolt as it slides until forced into a hole. A body is attached to the cylinder and the body is secured to the slidable first member to be interlocked. A D-spring on the body engages a D-spring notch on the bolt, locking the bolt in the projected position, thereby interlocking the two members. The body and handle, attached to the bolt, have flat surfaces which when aligned indicate that the D-spring is engaged to the D-spring notch. The handle must be rotated to disengage the D-spring and D-spring notch before the handle and bolt can be retracted. A secondary pair of D-spring notches forward on each side of the bolt at 90 degrees to the first D-spring notch engage the D-spring to retain the bolt in a retracted unlocked position for free sliding of the two members. Sliding windows, sliding doors, movable shelves and other slidably interactive members may be locked together.

15 Claims, 8 Drawing Figures

AUTOMATIC BOLT LOCK

DESCRIPTION

BACKGROUND OF THE INVENTION

TECHNICAL FIELD

The present invention relates to devices for locking windows, sliding doors and shelves in place and in particular a device whose bolt cannot be shaken or jiggled out of its locked position and which automatically locks into position when it reaches a hole.

BACKGROUND ART

Devices to lock windows and sliding doors in position are often difficult to install because of numerous parts which must be installed in the different parts of the windows or sliding doors.

In most tamper-proof locks, keys, magnets and the like are often required to retract the locking device, which can be dangerous if an emergency requires opening the window or sliding door immediately, and the key, magnet or the like is not readily available.

Other devices which do not require a key, magnet or the like are not child proof because a child can easily retract the locking device.

The handles of other devices give no indication of the position of the lock.

The handles of other locking devices may allow gripping of burgular tools when the window or door is locked or partially open for ventilation.

DISCLOSURE OF INVENTION

The present invention provides an easily installed device for locking windows and sliding doors in position because it requires only one drilling operation and it may be inserted into position in one piece and simply screwed in place.

The bolt may be retracted without the use of a key, magnet or the like by rotating the handle and retracting the handle until the bolt is locked in the retracted position thereby allowing quick and easy unlocking of the window or sliding door in an emergency.

The design of the device makes it essentially child proof because the operation requires a special turning and pulling action for proper orientation to engage and disengage the bolt, not apparent to someone unfamiliar with the lock's operation.

The tapered shape of the handle prevents gripping by burgular tools and the flush fit between the handle and body prevents insertion of burgular tools when the window or door is locked partially open for ventilation. The requirement that the handle must first be rotated before the bolt can be retracted makes defeating the device by the use of burgular tools very difficult. The hardened steel bolt itself is not easily cut through or broken.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
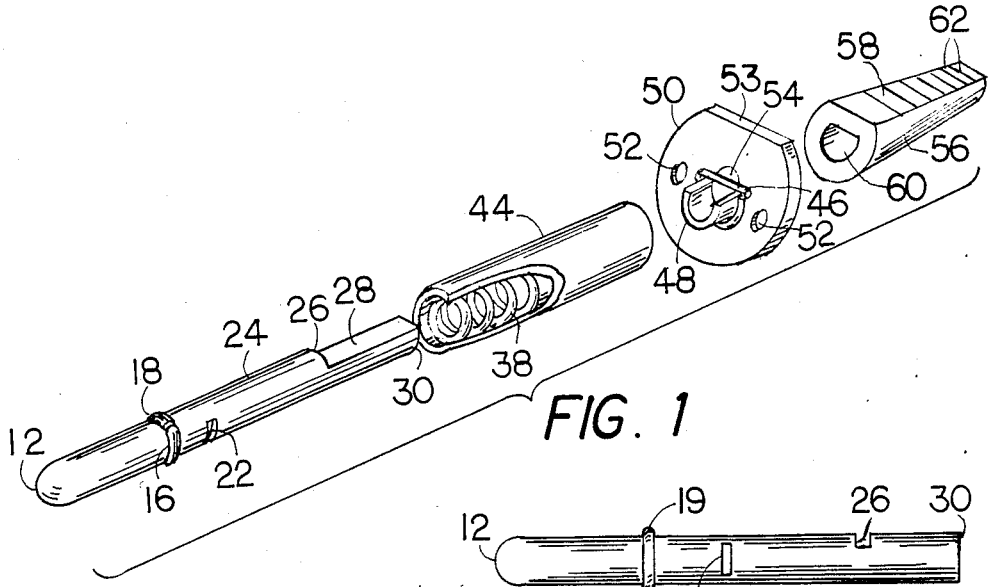
FIG. 1 is an exploded perspective view in partial section of the components of the automatic bolt lock aligned for assembly.

In FIG. 1 the preferred embodiment of the lock body 50 comprises a flat truncated circular plate with a C-shaped protrusion 48 extending from the front side forming a short cylinder truncated along the top. A primary central hole 54 extends through the body 50 and the C-shaped protrusion 48. Secondary holes 52 on either side of the first hole 54 receive fastening means, such as self-tapping screws to secure the lock-body to a sliding window, door or other member to be locked. Alternatively, the embodiment may only have the first hole 54 if an adhesive or other securing means is utilized. A truncated surface 53 in the top of the circular plate aligns in parallel with the open truncated plane of the C-shaped protrusion 48. A D-spring 46 is placed over the C-shaped protrusion 48 such that the D-spring 46 is against the front side and the straight portion of the D-spring forms a secant across a portion of the primary hole 54.

An elongated hollow cylinder 44 is placed over the C-shaped protrusion 48 forming a snug fit.

A coil spring 38 which is slightly longer than the cylinder 44 is inserted into the cylinder 44 and abuts the end of the C-shaped protrusion 48.

Figure 2:
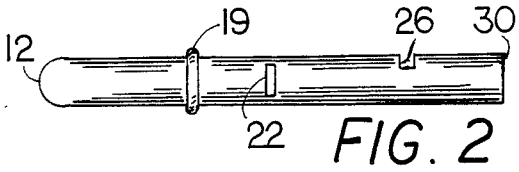
FIG. 2 is a side elevational view of an alternate emobdiment of the bolt.
Figure 3:
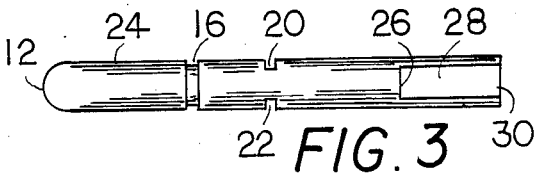
FIG. 3 is a top plan view of the preferred embodiment of the bolt having a planar surface on the end.

The preferred embodiment of the bolt 24 is shown in FIGS. 1 and 3. A planar surface 28 extends from the back end 30 to the first D-spring notch 26. The alternative embodiment of the bolt may have the first D-spring notch 26 as shown in FIG. 2 without a planar surface. A second D-spring notch 20 and a third D-spring notch 22 are positioned opposite each other near the approximate center of the bolt 24 offset approximately 90 degrees from positioned forward of the first D-sring notch 26 as shown in FIGS. 1 and 3. An alternative embodiment may have only the second D-spring notch 20. The bolt 24 also has a circular spring retaining ring groove 16 positioned closer to the front end 12 than the second D-spring notch 20 and third D-spring notch 22 as shown in FIGS. 1 and 3. In FIG. 2 the alternate embodiment of the bolt provides a rigned protrusion 19 formed in the bolt around the circumference of the bolt to serve as the coil spring retaining means. The front end 12 of the bolt is beveled or rounded for easy insertion into holes.

A spring retaining ring 18 is inserted into the spring retaining ring groove 16.

The bolt 24 is inserted through the coil spring 38, cylinder 44, D-spring 46, C-shaped protrusion 48 and plate of the lock body 50, such that the spring retaining ring 18 compresses the coil spring 38 biasing the bolt 24 into the projected position thereby preventing the bolt 24 from being jiggled out of position even if the D-spring 46 is not engaged with the first D-spring notch 26. The spring retaining ring also forms a seal with the end of the cylinder 44 to prevent foreign matter from entering the cylinder 44.

The handle 56 is securely fitted over the back end 30 of the bolt 24 which extends through the hole 54 in the plate of the lock body 50. The preferred embodiment of the handle 56 is cone shaped and has knurls 62 for positive gripping and a planar surface 58 on its top side which aligns in parallel with the planar surface 28 of the bolt 24 inserted within the shaped opening 60 to receive the back end 30 of the bolt.

When the device is assembled in its preferred embodiment, the handle 56 is flush with the plate of the lock body 50, the D-spring 46 is engaged in the first D-spring notch 26, the spring retaining ring 18 compresses the coil spring 38 and forms a seal with the end of the cylinder 44, the front end 12 of the bolt 24 is projected beyond the cylinder 44 and the planar surface 28 of the bolt 24, the truncated surface 53 of the plate and the planar surface 58 of the handle 56 are all aligned in parallel.

The bolt 24 cannot be retracted because the D-spring 46 is engaged in the first D-spring notch 26, thereby locking the bolt in its projected position. To retract the bolt 24, the handle 56 is rotated approximately 90 degrees. This disengages thje D-spring 46. Retracting the handle 56 until the D-spring 46 engages either the second D-spring notch 20 or the third D-spring notch 22 depending on which way the handle 56 was rotated. The bolt 24 has been retracted such that substantially the entire length of the bolt 24 is within the cylinder 44. To project the bolt 24 forward, the handle 56 is rotated in reverse through 90 degrees so that the planar surface 58 is on the top in alignment with the truncated surface 53. The spring 38 will bias the bolt 24 into the projected position. The D-spring 46 will automatically engage the first D-spring notch 26.

The requirement that the handle 56 first be rotated makes it more difficult for burgulars to defeat the device using burgular tools.

The biasing of the bolt 24 into the projected position by the coil spring 38 will maintain security even if the D-spring 46 is not engaged with the first D-spring notch 26.

The device is essentially child proof. The handle 56 must be properly rotated and then retracted until the D-spring 46 engages either the second D-spring notch 20 or the third D-spring notch 22 before the bolt 24 will remain retracted. If the rotation does not properly align D-spring 46 with either the second D-spring notch 20 or third D-spring notch 22 or the handle 56 is not retracted far enough, the spring will bias the bolt 24 into the projected position.

The coding of the handle makes the device easy to use for someone knowing the code when the window or sliding door must be unlocked quickly or if a blind person wishes to use the device.

Figure 4:
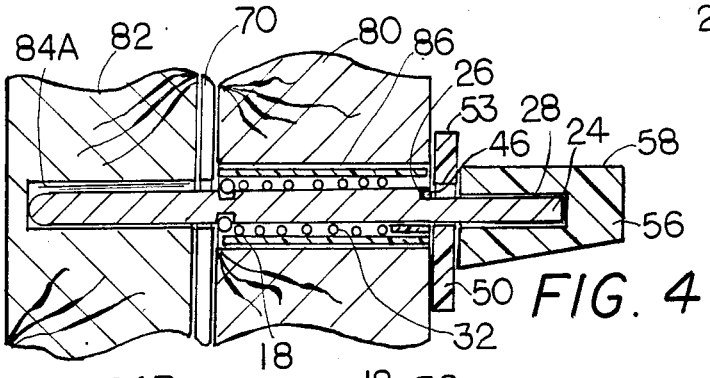
FIG. 4 is a cross sectional view in elevation of the automatic bolt lock, in the locked position installed on a double sash vertical sliding window.
Figure 5:
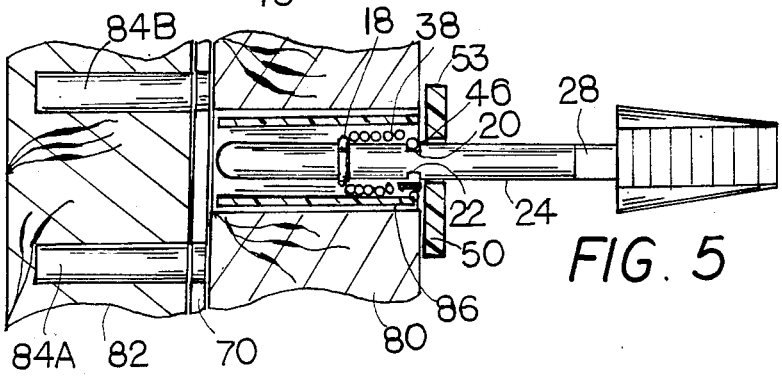
FIG. 5 is the same view with the device in the unlocked position and the bottom sash moved vertically.
Figure 6:
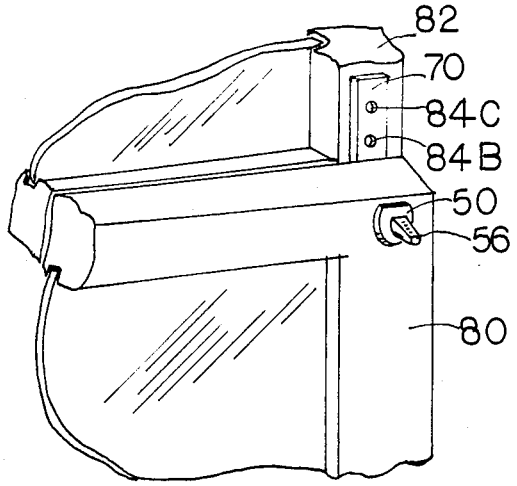
FIG. 6 is a partial perspective view of the invention installed on a double sash vertical sliding window in the locked closed position.

In FIGS. 4, 5 and 6, to install the device on a vertically double hung window, an optional striker plate 70 is secured to the inside lower right or left side corner of the outside window sash 82. With the window in its closed position, a hole is drilled through the corresponding top right or left side corner of the inside window sash 80 (forming hole 86) through the striker plate 70 and partially into the outside window sash 82 (forming hole 84A). The automatic bolt lock device is inserted into the hole with the cylinder 44 in the inside sash hole 86 such that the plate of the lock body 50 is flush with the inside window sash 80 and the truncated surface 53 is on top. The lock body 50 is secured in this position preferably by screwing into the sash. The front end 12 of the bolt 24 projects through the striker plate 70, into the outside window sash hole 84A, locking the window closed.

A second hole 84B can be drilled above the first hole 84A through the striker plate 70, partially into the outside window sash 82. The window can then be locked into a partially opened position to allow ventilation yet maintain security.

Figure 7:
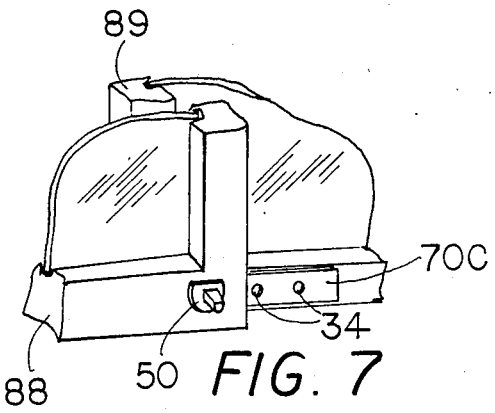
FIG. 7 is a partial perspective view of the invention installed on a horizontally sliding glass door or window in the partially open locked position.

The automatic bolt lock device 50 may similarly be installed in a horizontal double hung sliding window or a sliding door 88 and 89 as in FIG. 7, also utilizing a series of holes 84 in a striker plate 70C.

Figure 8:
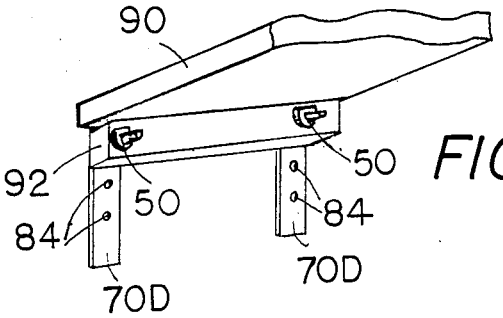
FIG. 8 is a partial perspective view of the invention used as an adjustable shelf securing means.

In FIG. 8, the automatic bolt locking device 50 is used to lock an adjustable shelf 90 into place by securing a device 50 through each of two ends of a support bracket 92. Adjustability is provided by securing the device in each of a series of horizontally aligned pairs of holes 84 in striker plates 70D secured in parallel vertical alignment to a wall or vertical end support for a bookcase.

Preferably the bolt 24 is fabricated of hardened steel, the springs are spring steel and the other components are molded plastic or steel. The device can be made in various sizes with various length bolts to suit the desired application.

It is understood that the preceding description is given merely by way of illustration and not in limitation and that various modifications may be made thereto without departing from the spirit of the invention as claimed.

I claim:

1. An automatic bolt lock for locking sliding windows, sliding doors and other sliding interactive members to be locked in any of a multiplicity of positions wherein the automatic bolt lock comprises:

a lock body comprising a circular hole through an approximate center of the body and a means for securing the lock body to a first sliding member;

a front side of the lock body to be positioned against such first sliding member and a back side of the lock body to be positioned away from such first sliding member;

a D-spring secured to the front side of the lock body, over the circular hole, such that a circular portion of the D-spring conforms to the curve of the circular hole and a straight portion of the D-spring forms a secant across a portion of the circular hole;

an elongated hollow cylinder attached to the front side of the lock body over the D-spring and the hole;

a coil spring inserted into the cylinder;

an elongated bolt, slidably positioned through the coil spring, cylinder, D-spring and hole such that the bolt may be retracted or projected in relation to the front side of the body wherein the bolt comprises;

a front and a back end;

a first D-spring notch in the bolt perpendicular to the long axis of the bolt and positioned near the back end of the bolt;

a second D-spring notch in the bolt perpendicular to the long axis of the bolt, offset approximately 90 degrees from the first D-spring notch and positioned forward of the first D-spring notch;

a coil spring retaining means around the bolt, perpendicular to the long axis of the bolt and positioned forward of the second D-spring notch to retain the coil spring between the retaining means and the lock body, wherein the coil spring tends to force the bolt forward;

a handle firmly attached to the back end of the bolt for protrusion outwardly from the first sliding member;

wherein such a first sliding member may be provided with a hole completely therethrough, through which first member hole the bolt would be free to slide and a second sliding member may be provided with at least one aligned hole into which the bolt may slide removably;

and wherein the bolt may be secured in a locked position between the two sliding members by engaging the straight portion of the D-spring in the first D-spring notch, and wherein the bolt further comprises a third D-spring notch in the bolt perpendicular to the long axis of the bolt and positioned opposite the second D-spring notch, and wherein the bolt further comprises a planar surface parallel to the long axis of the bolt positioned on the same side of the bolt as the first D-spring notch and which planar surface extends to the back end of the bolt and the lock body further comprises a truncated surface perpendicular to the backside of the body in parallel with the straight portion of the D-spring and the handle further comprises a planar surface such that when the planar surface of the bolt, the truncated surface of the body and the planar surface of the handle are in parallel alignment and the circular portions of the bolt, D-spring and handle are concentric the D-spring will lock into the first D-spring groove if the bolt is allowed to project forward in relation to the front side of the body by force of the coil spring and when the handle is rotated approximately 90 degrees, the bolt also rotates approximately 90 degrees disengaging the D-spring from the first D-spring groove, positioning the planar surface of the bolt and handle approximately perpendicular to the truncated surface of the lock body such that when the bolt is retracted in relation to the front side of the body, the straight portion of the D-spring will lock into the second D-spring groove or the third D-spring groove depending on which direction the handle is rotated.

2. An automatic bolt lock for locking sliding windows, sliding doors and other sliding interactive members to be locked in any of a multiplicity of positions wherein the automatic bolt lock comprises:

a lock body comprising a circular hole through an approximate center of the body and a means for securing the lock body to a first sliding member;

a front side of the lock body for positioning against such first sliding member and a back side of the lock body for positioning away from the first sliding member;

a D-spring secured to the front side of the lock body, over the circular hole, such that a circular portion of the D-spring conforms to the curve of the circular hole and a straight portion of the D-spring forms a secant across a portion of the circular hole;

an elongated hollow cylinder attached to the front side of the lock body over the D-spring and the hole;

a coil spring inserted into the cylinder;

an elongated bolt, slidably positioned through the coil spring, cylinder, D-spring and hole such that the bolt may be retracted or projected in relation to the front side of the body wherein the bolt comprises;

a front and a back end;

a first D-spring notch in the bolt perpendicular to the long axis of the bolt and positioned near the back end of the bolt;

a second D-spring notch in the bolt perpendicular to the long axis of the bolt, offset approximately 90 degrees from the first D-spring notch and positioned forward of the first D-spring notch;

a coil spring retaining means around the bolt, perpendicular to the long axis of the bolt and positioned forward of the second D-spring notch to retain the coil spring between the retaining means and the lock body, wherein the coil spring tends to force the bolt forward;

a handle firmly attached to the back end of the bolt for protrusion outwardly from the first sliding member;

wherein such a first sliding member may be provided with a hole completely therethrough, through which first member hole the bolt would be free to slide and a second sliding member may be provided with at least one aligned hole into which the bolt may slide removably;

and wherein the bolt may be secured in a locked position between such sliding members by engaging the straight portion of the D-spring in the first D-spring notch;

wherein the lock body further comprises a C-shaped protrusion over the hole extending from the front side of the body such that the D-spring and then the cylinder can be placed over the C-shaped protrusion to secure the D-spring in position.

3. The invention of claim 2 wherein the coil spring retaining means comprises a ringed protrusion formed around the circumference of the bolt.

4. The invention of claim 2 wherein the coil spring retaining means comprises a groove formed in the bolt around the circumference of the bolt having a circular ring fitted within the circular groove, wherein the circular ring protrudes above the surface of the bolt to retain the coil spring.

5. The invention of claim 2 wherein the handle is cone shaped and further comprises knurles for positive gripping.

6. The invention of claim 2 wherein the lock body further comprises at least one additional hole through which a securing means can be placed to secure the invention to the first slidable member.

7. The invention of claim 2 wherein the front end of the bolt is beveled for ease of insertion into a hole in the second slidable member.

8. The invention of claim 1 wherein the lock body further comprises a C-shaped protrusion over the hole extending from the front side of the body such that the D-spring and then the cylinder can be placed over the C-shaped protrusion to secure the D-spring in position.

9. The invention of claim 2 wherein the D-spring with supporting C-shaped protrusion and covering cylinder fit within the hole in the first slidable member so the D-spring is tamper-proof.

10. The invention of claim 2 wherein said bolt is structure such that such second slidable member when comprising a series of holes aligned in a direction corresponding to a sliding action between the first and second slidable members, the bolt may be locked within any one of the series of holes.

11. The invention of claim 2 further comprising a striker plate for securement to the second slidable member, wherein the striker plate comprises a hole through the striker plate to align with each hole in the second member so that the front end of the bolt may slide against the striker plate until the bolt is forced into a hole by the coil spring.

12. An automatic bolt lock for locking sliding windows, sliding doors, and any slidably interactive members in any of a multiplicity of positions wherein the automatic bolt lock comprises:

a lock body comprising a first circular hole through an approximate center of the lock body, at least one additional hole through which a securing means can be placed to secure the lock body to a first slidable member, a front side of the lock body for securement against the first slidable member, and a back side of the lock body to be positioned away from the first slidable member, a C-shaped protrusion over the first hole extending from the front side of the lock body, which may be positioned in a hole through such first slidable member and a truncated surfce perpendicular to the back side of the lock body;

a D-spring placed over the C-shaped protrusion so that a straight portion of the D-spring forms a secant across a portion of the first circular hole in the lock body;

an elongated hollow cylinder placed over the C-shaped protrusion, covering the D-spring, wherein the hollow cylinder may fit within the hole through the first slidable member;

a coil spring inserted into the cylinder;

an elongated bolt, slidably positioned through the coil spring, cylinder, D-spring and first hole in the lock body so that the bolt may be retracted or projected in relation to the front side of the lock body through the hole in the first slidable member and extending beyond the first slidable member to fit removably in at least one aligned hole in a second slidable member and wherein the bolt comprises:

a front end for positioning through through the first slidable member for interacting with the second slidable member;

a back end through the lock body;

a first D-spring notch in the bolt perpendicular to the long axis of the bolt and positioned near the back end of the bolt;

a second D-spring notch in the bolt perpendicular to the long axis of the bolt, offset approximately 90 degrees from the first D-spring notch and positioned forwardly of the first D-spring notch;

a third D-spring notch in the bolt perpendicular to the long axis of the bolt and positioned opposite the second D-spring notch;

a planar surface, parallel to the long axis of the bolt, positioned on the same side of the bolt as the first D-spring notch between the first D-spring notch and the back end of the bolt;

a coil spring retaining means around the bolt, perpendicular to the long axis of the bolt and positioned closer to the front end of the bolt than the second D-spring notch to retain the coil spring between the retaining means and the lock body, wherein the coil spring tends to force the bolt forward;

a cone shaped handle firmly attached to the back end of the bolt, comprising knurls for positive gripping, a planar surface such that when the planar surface of the bolt, the truncated surface of the body and the planar surface of the handle are in parallel alignment, the D-spring will lock into the first D-spring groove if the bolt is allowed to project forward in relation to the front side of the body by force of the spring, thereby locking the bolt into a hole in the second slidable member; and when the handle is rotated approximately 90 degrees, the bolt also rotates approximately 90 degrees disengaging the D-spring from the first D-spring groove positioning the planar surface of the bolt and the planar surface of the handle approximately perpendicular to the truncated surface such that when the bolt is retracted in relation to the front side of the body, the D-spring will lock into the second D-spring groove or the third D-spring groove depending on which direction the handle is rotated thereby holding the bolt away from the second slidable member.

13. The invention of claim 12 further comprising a striker plate for securement to such a second slidable member, wherein the striker plate comprises a hole through the striker plate to align with each hole in the second slidable member, so that the front end of the bolt slides against the striker plate during relative sliding of the slidable members until the bolt encounters a hole and is forced therein by the coil spring.

14. The invention of claim 12 wherein the coil spring retaining means comprises a ringed protrusion formed around the circumference of the bolt.

15. The invention of claim 12 wherein the coil spring retaining means comprises a groove formed in the bolt around the circumference of the bolt having a circular ring fitted within the circular groove, wherein the circular ring protrudes above the surface of the bolt to retain the coil spring.

* * * * *